US009167929B1

(12) United States Patent
Henry

(10) Patent No.: US 9,167,929 B1
(45) Date of Patent: Oct. 27, 2015

(54) BOOT DOFFING ASSISTANCE DEVICE

(71) Applicant: Thomas Brooks Henry, Jay, FL (US)

(72) Inventor: Thomas Brooks Henry, Jay, FL (US)

( * ) Notice: Subject to any disclaimer, the term of this patent is extended or adjusted under 35 U.S.C. 154(b) by 67 days.

(21) Appl. No.: 14/042,898

(22) Filed: Oct. 1, 2013

(51) Int. Cl.
*A47G 25/80* (2006.01)
*A47G 25/86* (2006.01)

(52) U.S. Cl.
CPC ..... *A47G 25/80* (2013.01); *A47G 25/86* (2013.01)

(58) Field of Classification Search
CPC ..... A47G 25/80; A47G 25/84; A47G 25/86
See application file for complete search history.

(56) References Cited

U.S. PATENT DOCUMENTS

| | | | | | |
|---|---|---|---|---|---|
| 8,865 | A | | 4/1852 | Thomson | |
| 10,016 | A | | 9/1853 | Summer | |
| 22,404 | A | | 12/1858 | Ahl | |
| 84,862 | A | | 12/1868 | Darden | |
| 98,219 | A | | 12/1869 | Babcock | |
| 110,743 | A | | 1/1871 | Crabtree | |
| 111,613 | A | | 2/1871 | Coleman | |
| 112,638 | A | | 3/1871 | Rouard | |
| 147,069 | A | | 2/1874 | Sawyer et al. | |
| 190,508 | A | | 5/1877 | Niver | |
| 235,054 | A | * | 11/1880 | Gatrell | 223/115 |
| 275,551 | A | | 4/1883 | Walker | |
| 304,956 | A | | 9/1884 | Reining | |
| 370,197 | A | | 9/1887 | Kennedy | |
| 427,675 | A | * | 5/1890 | Dezell | 223/115 |
| 459,680 | A | | 9/1891 | Donauer | |
| 503,838 | A | | 8/1893 | Even | |
| 1,210,295 | A | | 12/1916 | Fogelstrom et al. | |
| 1,636,010 | A | | 7/1927 | Moland | |
| 1,748,643 | A | | 2/1930 | Folsom | |
| 1,769,516 | A | * | 7/1930 | Kosch | 223/114 |
| 2,603,393 | A | | 7/1952 | Oblusteel | |
| 3,786,970 | A | | 1/1974 | Dixon | |
| D238,454 | S | | 1/1976 | McDouglas | |
| D245,648 | S | | 9/1977 | Taylor | |
| D259,301 | S | | 5/1981 | Cowart et al. | |
| D320,109 | S | | 9/1991 | Chew | |
| D338,100 | S | | 8/1993 | Fuccillo | |
| D372,113 | S | * | 7/1996 | Palmer et al. | D2/641 |
| D487,608 | S | | 3/2004 | Birnbaum | |
| 2007/0125813 | A1 | * | 6/2007 | Portuesi et al. | 223/114 |

* cited by examiner

*Primary Examiner* — Shaun R Hurley
*Assistant Examiner* — Andrew W Sutton
(74) *Attorney, Agent, or Firm* — Peter Loffler

(57) ABSTRACT

A boot removal assistance device uses a base plate and a removal plate joined by a post. The removal plate has a bottom leg and an arcuate shaped top leg joined by a pair of opposing side members defining a central opening that is wider side to side relative to the top to bottom distance. A user places a boot into the central opening while standing on the base plate with the other leg. The heel of the boot is braced against the inside edge of the bottom leg while the toe portion of the boot is braced underneath the top leg. The boot is now braced and the user pulls his or her leg out of the boot.

20 Claims, 5 Drawing Sheets

BOOT DOFFING ASSISTANCE DEVICE

BACKGROUND OF THE INVENTION

1. Field of the Invention

The present invention relates to a boot removal assistance device that allows a person to be able to remove a boot unassisted while in a standup position.

2. Background of the Prior Art

Boot wearers know that the only thing more difficult than putting on a pair of comfortable, tight fitting boots, is removing the boots at the end of the day. Boots, especially cowboy boots, also known as riding boots, are designed to snugly fit the wearer's foot without the use of closure devices such as laces, snaps, or cooperating hook and loop material. As a riding boot does not use a closure device, the boot itself provides the fit and securement about the wearer's foot so that the wearer's foot, including the ankle, is tightly fit within the boot. This tight fitting nature of the boot makes donning and doffing a properly sized boot somewhat difficult.

This donning and doffing difficulty is not only due to the tight fitting nature of the boot about the wearer's foot, but also due to the fact that a person's ankle is substantially more narrow relative to the metatarsal region of the foot, so that when the person's relatively wide metatarsal portion of his or her foot is passing through the relatively narrow ankle portion of the boot, through passage of the foot becomes difficult. While most boots have some give to allow the ankle portion to yield some room whenever the metatarsal portion of the foot is passing therethrough, foot passage through the ankle is often a challenge, especially in a newer boot that has yet to be fully broken in.

While both donning and doffing of a boot present a challenge, donning a boot tends to be a bit easier. The wearer grabs the top of the boot, inserts the foot, and uses gravity to assist in shoving the foot into the boot into proper position. Donning a boot tends to be a job for a single person—the wearer.

Doffing on the other hand presents a different problem. Not only does the wearer not have the benefit of gravity to assist him or her in boot doffing, typically the person's foot has swelled somewhat from wearing the boot, so that foot removal from the boot is even more challenging.

Many boot wearers employ a second person to help in the doffing process. The second person grabs the bottom portion of the boot and the wearer and the assistant pull in opposing directions until the foot is released from its boot confines. While effective, this technique is not without its limitations. Sometimes, a second person is simply not available so this boot removal method cannot be employed. Even if a second person is available, many boot wearers' egos do not permit employment of such assistance and such boot wearers will simply struggle to remove the boots themselves.

Of course, such boot doffing problems are not limited to riding boots. Snow ski boots, skates, and other types of boots and shoes also present problems during removal.

Recognizing the problems associated with boot doffing, devices have been proposed that allow a person to be able to remove a boot from his or her foot without the assistance of a second person. Such devices, which come in a variety of architectures, tend to suffer from one or more drawbacks. Many such prior art devices are simply complex in design and construction so as to be relatively expensive to produce so as to reduce the economic attractiveness of such devices. Some prior art devices are unduly complex in operation, so that many potential users, especially casual users, tend to shy away from usage of such devices. Such devices also tend to have relatively high maintenance requirements. Some devices are simply ineffective to use, offering little more assistance than solo removal of the boot by the wearer.

What is needed is a device that allows a person to be able to doff a tight fitting boot or other type of footwear from his or her foot without assistance from a second person, which device addresses the above mentioned limitations found in the art. Specially, such a device must be of relatively simple design and construction so that the device is relatively simple and inexpensive to produce and maintain. Such a device must be simple and straightforward to use so as to be welcoming to most boot wearers including casual boot wearers.

SUMMARY OF THE INVENTION

The boot doffing assistance device addresses the aforementioned needs in the art by providing a device that allows a person to be able to use the device to remove a boot or other type of footwear from his or her foot unassisted. The boot doffing assistance device is of relatively simple design and construction, being produced using standard manufacturing techniques, so that the device is relatively inexpensive to produce so as to be economically attractive to potential consumers for this type of device. The boot doffing assistance device has no moving parts so that the present invention is relatively simple to use as well as to maintain. The boot doffing assistance device is designed to be used with various types of boots including snow ski boots and skates and other types of footwear.

The boot doffing assistance device is comprised of a base member that has a first upper surface located on a first plane. A plate has a bottom leg that has a second upper surface located on a second plane and a lower surface and a top leg that has a third upper surface located on a third plane. The bottom leg and the top leg are joined by a pair of spaced apart opposing side legs. A central opening is defined by the bottom leg, the top leg, and the two side legs, such that the third plane of the top leg is disposed at an angle relative to the second plane. A post extends between the first upper surface of the base member and the lower surface of the bottom leg in order to secure the plate to the base member in spaced apart relationship above the base member. The first plane of the base member and the second plane of the bottom leg are essentially parallel. The top leg is arcuate shaped as is the top leg's inside edge. An optional handle extends upwardly from the third upper surface of the top leg. A first distance between the pair of side legs is greater than a second distance between the bottom leg and the top leg—the central opening is wider between the pair of side legs than between the top leg and the bottom leg.

BRIEF DESCRIPTION OF THE DRAWINGS

Similar reference numerals refer to similar parts throughout the several views of the drawings.

DESCRIPTION OF THE PREFERRED EMBODIMENT

Figure 1:
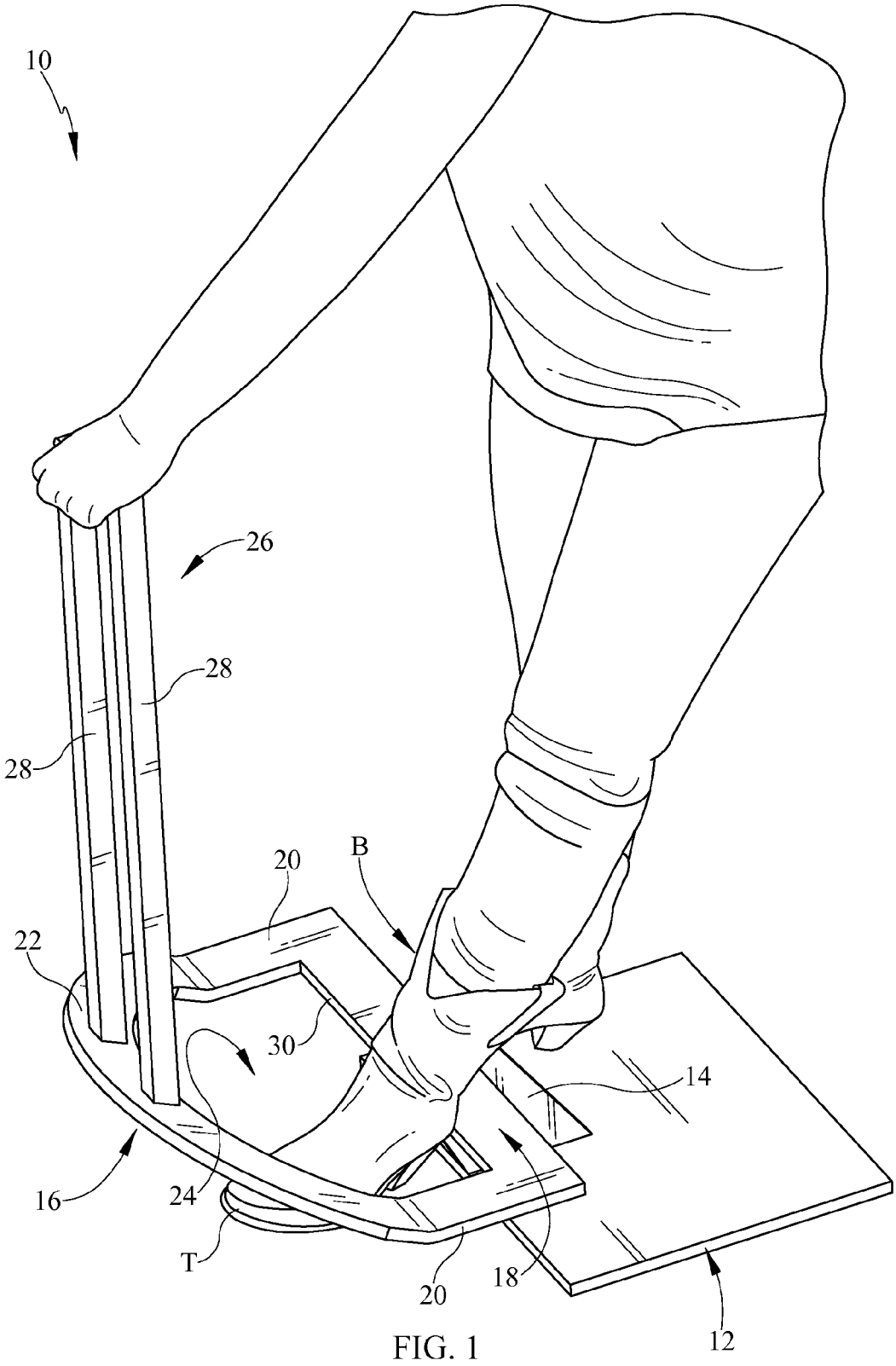
FIG. 1 is a front perspective view of the boot doffing assistance device of the present invention being used by a person to remove a boot from the person's foot.
Figure 2:
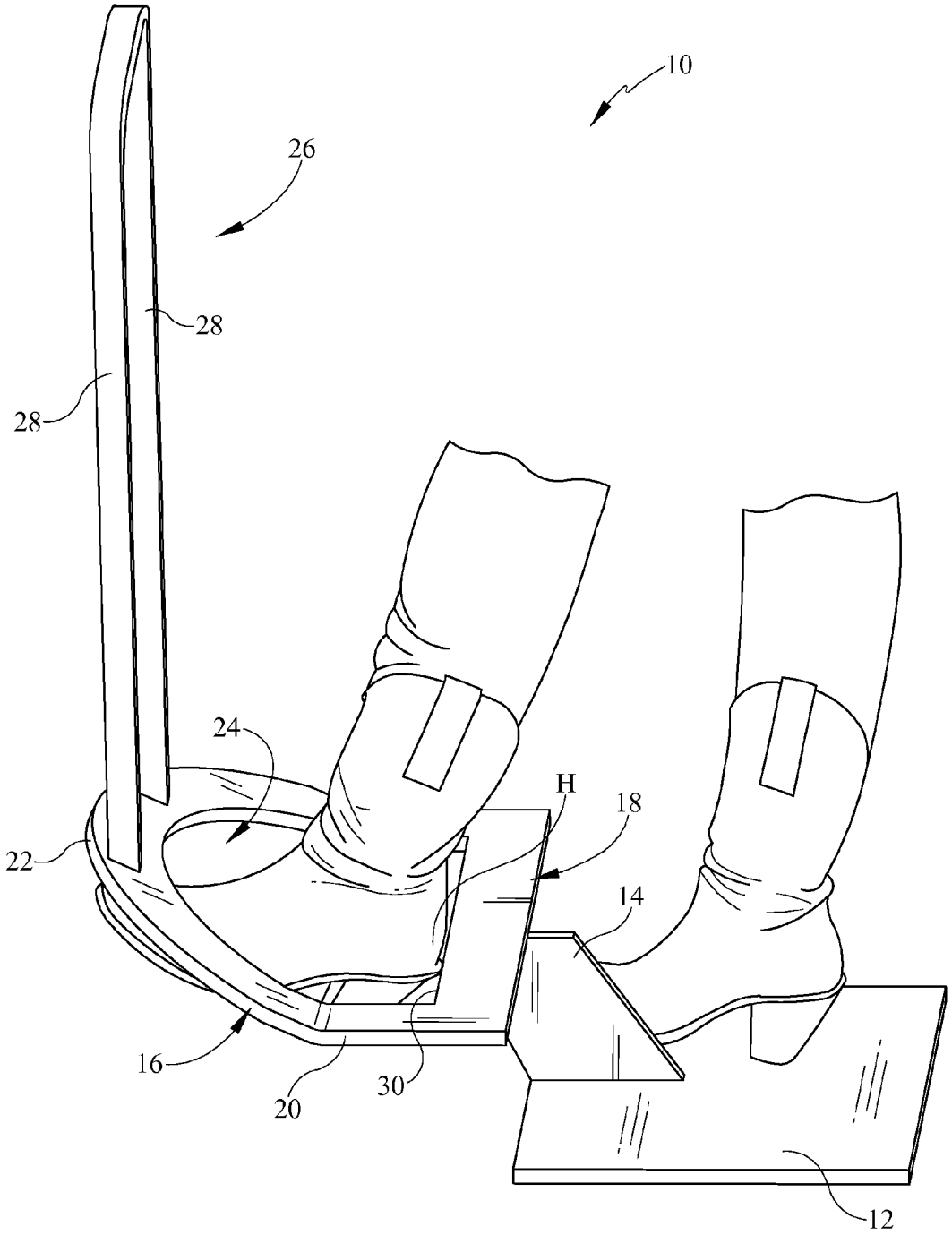
FIG. 2 is a side perspective view of the boot doffing assistance device being used by a person to remove a boot from the person's foot.
Figure 3:
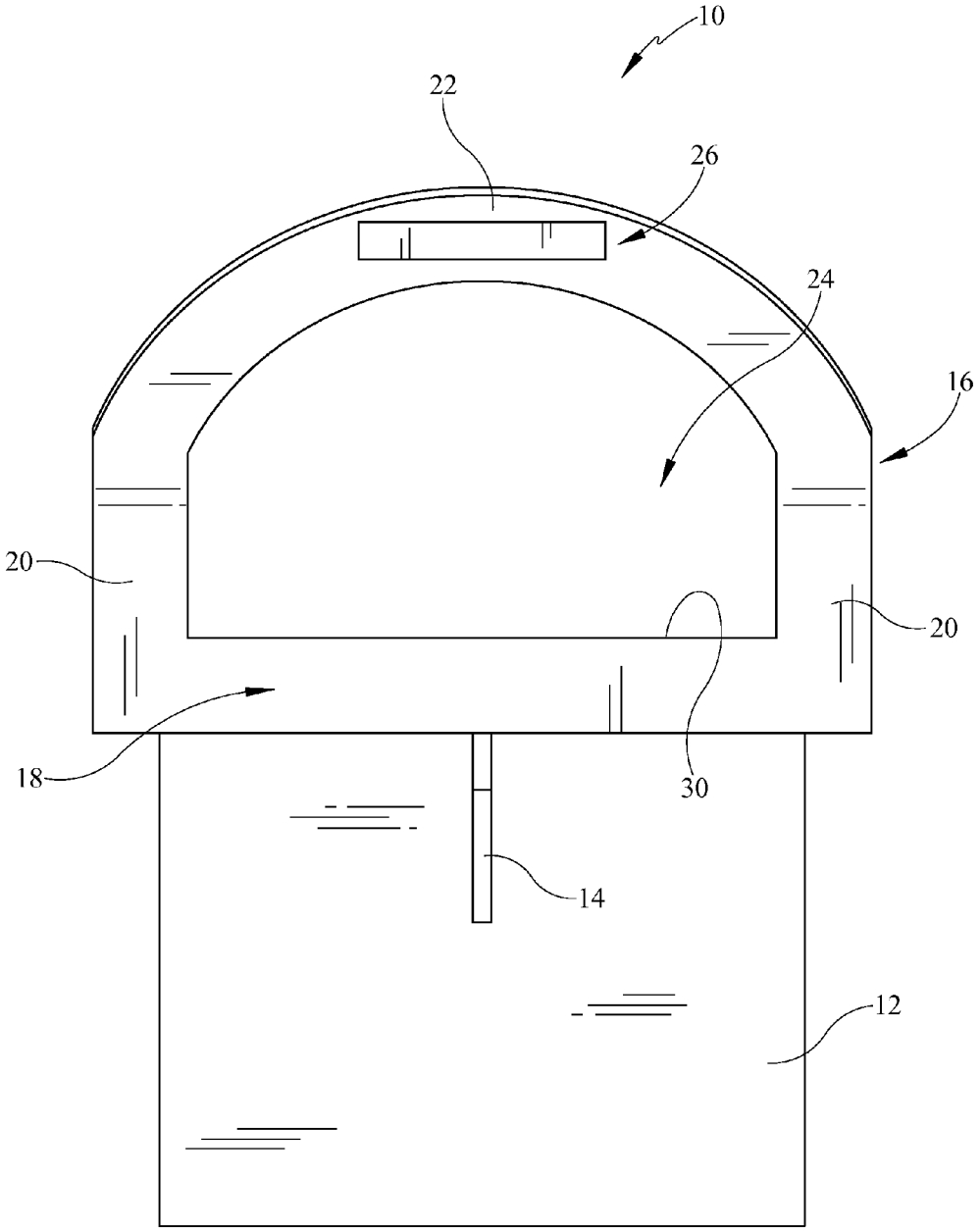
FIG. 3 is a plan view of the boot doffing assistance device.
Figure 4:
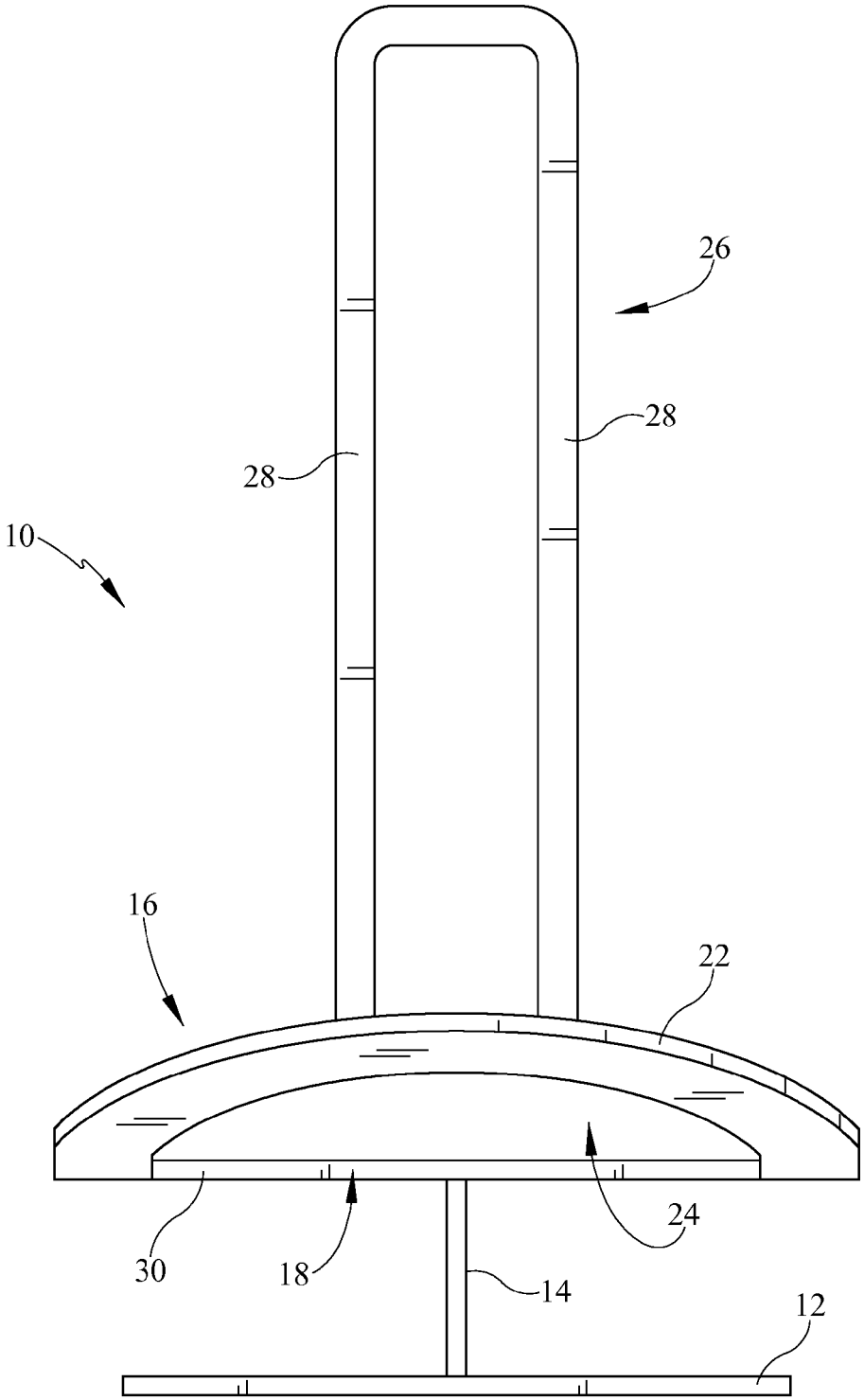
FIG. 4 is a front elevation view of the boot doffing assistance device.

Referring now to the drawings, it is seen that the boot doffing assistance device of the present invention, generally denoted by reference numeral 10, is comprised of a base member 12 that is a relatively flat plate member. A post 14 extends upwardly from the base member 12 such that a removal plate 16 is affixed to the top of the post 14, the removal plate 16 extending forwardly of the base plate 12. As seen, the removal plate 16 has a bottom leg 18 to which the post 14 is attached and has a pair of side legs 20 that extend outwardly from either end of the bottom leg 18. An arcuate top leg 22 extends between the ends of the pair of side legs 20. The base leg 18, the pair of side legs 20, and the top leg 22 form an opening 24 within the removal plate 16. The opening 24 is dimensioned so as to be relatively wider between the two side legs 20 than between the bottom leg 18 and the further point (the center point) of the top leg 22. The bottom leg 18 and the side legs 20 are all located on the same plane while the top leg 22 angles diagonally upwardly from this plane. An optional handle 26, having one, or as illustrated two posts 28 joined at the top, extends upwardly from the removal plate 16.

The various components of the boot doffing assistance device 10 are each made from an appropriate sturdy material such aluminum, steel, or other similar metal, or can be made from a relatively hard plastic, etc.

The various components of the boot doffing assistance device 10, especially the optional handle 26, can be removable from other respective components or the boot doffing assistance device 10 can be built so that most or all or the components are fixedly secured to one another in appropriate fashion such as via welding or the use of appropriate attachment hardware such as screws, bolts, or rivets.

The boot doffing assistance device 10 is dimensioned and weighted so that when the base plate 12 is resting on a relatively flat surface, the boot doffing assistance device 10 does not tend to tip due to the moment created by the forward positioning of the removal plate 16. Such anti-tipping tenancy can be obtained by proper weighting of the base plate 12 relative to the removal plate 16.

In order to use the boot doffing assistance device 10 of the present invention, a user positions one foot onto the base plate 12 and positions his or her other, boot B bearing foot within the opening 24 of the removal plate 16, this foot being the one from which the boot B is to be removed. This foot is positioned into the opening 24 either by dipping the front of the foot underneath the top leg 22 of the removal plate 16 and then passing the remainder of the foot into the opening 24, or if this is not possible or practical due the size of the boot B (such as a snow ski), then the foot is twisted so that the boot B comes into the opening 24 either opening totally or somewhat sideways. Once the boot-bearing foot is within the opening 24, the heel portion H of the boot B is positioned against the inside edge 30 of the bottom leg 18 while the toe portion T of the boot B is positioned underneath the top leg 22. The user moves his or her foot left or right of the midline passing between the bottom leg 18 and top leg 22 until the toe portion T of the boot B is comfortably underneath the top leg 22 of the removal plate 16. The user braces his or her heel H against the inside edge 30 of the bottom leg 18 and his or her toes and metatarsal portion of his or her foot against the underside of the top leg 22 of the removal plate 16 and uses this as a brace to hold the boot B firmly while the user pulls his or her leg out of the boot B. The angling of the top leg 22 relative to the bottom leg 18 allows the user to hold his or her foot at an approximately normal position relative to his or her leg, which is very comfortable relative to having to hyperextend his or her foot downwardly relative to the leg, if the top leg 22 were not so angled. The inside edges of the various legs, 18, 20, and 22, can be rounded for increased comfort of the user when using the boot doffing assistance device 10 to remove a boot B. The user, by standing on the base plate 12 with his or her other leg, steadies the boot doffing assistance device 10 during boot B removal.

Figure 5:
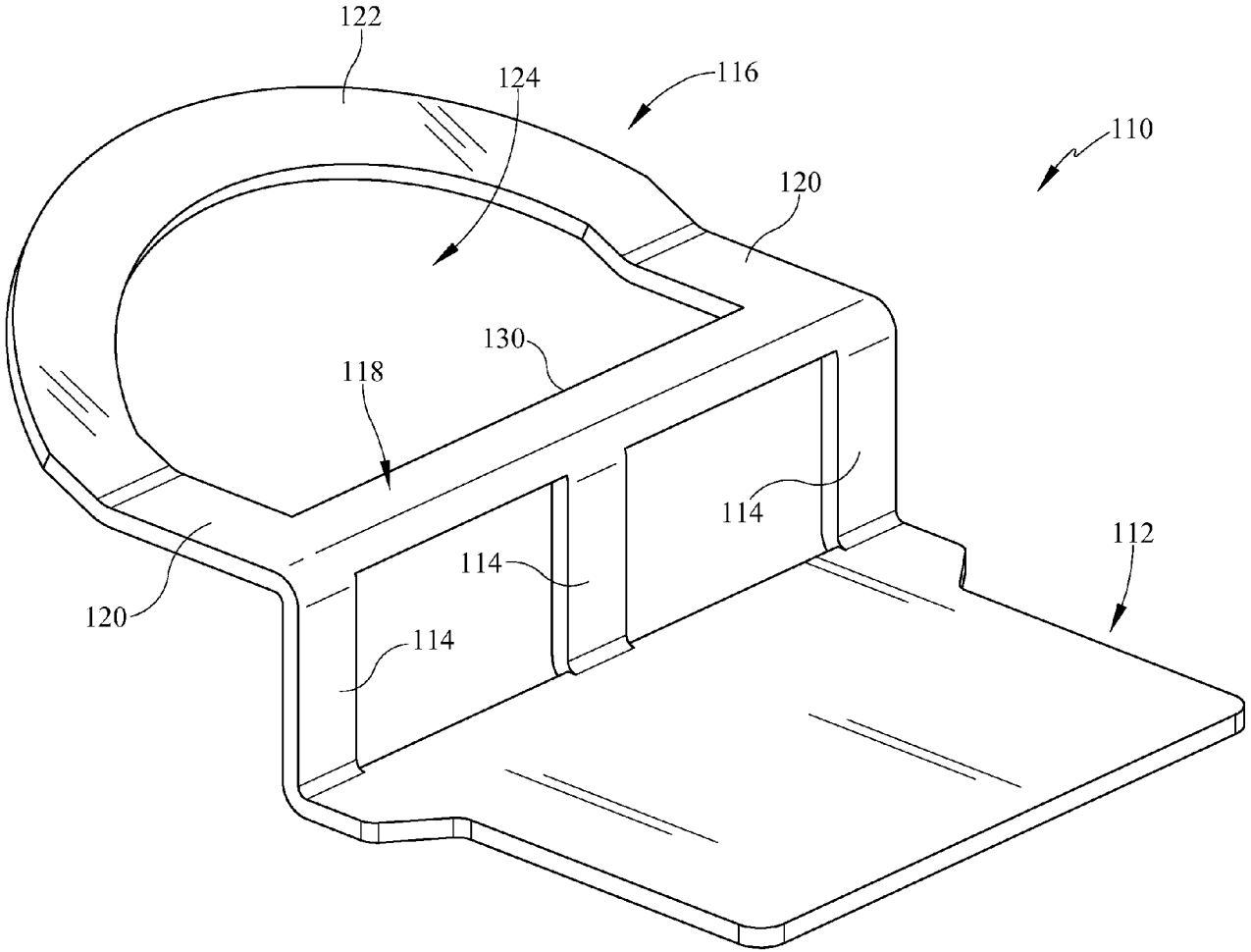
FIG. 5 is a perspective view of a lightweight version of the boot doffing assistance device of the present invention.

As seen in FIG. 5, a lightweight version of the boot doffing assistance device 110 of the present invention is comprised of a base member 112 that is a relatively flat plate member. One or more posts 114 extends upwardly from the base member 112 such that a removal plate 116 is affixed to the top of the posts 114, the removal plate 116 extending forwardly of the base plate 112. As seen, the removal plate 116 has a bottom leg 118 to which the one or more posts 114 are attached and has a pair of side legs 120 that extend outwardly from either end of the bottom leg 118. An arcuate top leg 122 extends between the ends of the pair of side legs 120. The base leg 118, the pair of side legs 120 and the top leg 122 form an opening 124 within the removal plate 116. The opening 124 is dimensioned so as to be relatively wider between the two side legs 120 than between the bottom leg 118 and the further point (the center point) of the top leg 122. The bottom leg 118 and the side legs 120 are all located on the same plane while the top leg 122 angles diagonally upwardly from this plane.

In this version of the boot doffing assistance device 110, the entire device can be formed from a sheet of metal, such as aluminum, with appropriate cuts made into the sheet to form the posts 114 and the opening 124 and thereafter appropriate bends are placed into the sheet to form the overall structure of the boot doffing assistance device 110.

Similar to the other boot doffing assistance device 10, in order to use this version of the boot doffing device 110 of the present invention, a user positions one foot onto the base plate 112 and positions his or her other, boot bearing foot within the opening 124 of the removal plate 116, this foot being the one from which the boot B is to be removed. This foot is positioned into the opening 124 either by dipping the front of the foot underneath the top leg 122 of the removal plate 116 and then passing the remainder of the foot into the opening 124, or if this is not possible or practical due the size of the boot B (such as a snow ski), then the foot is twisted so that the boot B comes into the opening 124 either totally or somewhat sideways. Once the boot-bearing foot is within the opening 124, the heel H portion of the boot B is positioned against the inside edge 130 of the bottom leg 118 while the toe portion T of the boot B is positioned underneath the top leg 122. The user moves his or her foot left or right of the midline passing between the bottom leg 118 and top leg 122 until the toe portion T of the boot B is comfortably underneath the top leg 122 of the removal plate 116. The user braces his or her heel H against the inside edge 130 of the bottom leg 118 and his or her toes and metatarsal portion of his or her foot against the underside of the top leg 122 of the removal plate 116 and uses this as a brace to hold the boot B firmly while the user pulls his or her leg out of the boot B. The angling of the top leg 122 relative to the bottom leg 118 allows the user to hold his or her foot at an approximately normal position relative to his or her leg, which is very comfortable relative to having to hyperextend his or her foot downwardly relative to the leg, if the top leg 122 were not so angled. The inside edges of the various legs, 118, 120, and 122, can be rounded for increased comfort of the user when using the boot doffing assistance device 110 to remove a boot B. The user, by standing on the base plate 112 with his or her other leg, steadies the boot doffing assistance device 110 during boot B removal.

While the invention has been particularly shown and described with reference to an embodiment thereof, it will be appreciated by those skilled in the art that various changes in form and detail may be made without departing from the spirit and scope of the invention.

I claim:

1. A removal device comprising:

a base member having a first upper surface located on a first plane;

a plate having a bottom leg that has a second upper surface located on a second plane and a lower surface, the plate also having a top leg that has a third upper surface located on a third plane, the bottom leg and the top leg joined by a pair of opposing side legs, such that a central opening is defined by the bottom leg, the top leg and the two side legs and such that third plane is disposed at an obtuse angle relative to the second plane; and a post extending between the first upper surface of the base member and the lower surface of the bottom leg in order to secure the plate above the base plate.

2. The removal device as in claim 1 wherein the first plane and the second plane are parallel.

3. The removal device as in claim 2 wherein the top leg is arcuate shaped.

4. The removal device as in claim 3 an inside edge of the top leg is arcuate.

5. The removal device as in claim 4 further comprising a handle extending upwardly from the third upper surface of the top leg.

6. The removal device as in claim 5 wherein a first distance between the pair of side legs is greater than a second distance between the bottom leg and the top leg.

7. The removal device as in claim 1 wherein the top leg is arcuate shaped.

8. The removal device as in claim 7 an inside edge of the top leg is arcuate.

9. The removal device as in claim 1 further comprising a handle extending upwardly from the third upper surface of the top leg.

10. The removal device as in claim 1 wherein a first distance between the pair of side legs is greater than a second distance between the bottom leg and the top leg.

11. A removal device comprising:

a base member having a first upper surface located on a first plane;

a plate having a bottom leg that has a second upper surface located on a second plane and a lower surface, the plate also having a top leg that has a third upper surface located on a third plane, the bottom leg and the top leg joined by a pair of opposing side legs, such that a central opening is defined by the bottom leg, the top leg and the two side legs and such that third plane is disposed at an obtuse angle relative to the second plane; and a post fixedly attached to the first upper surface of the base and extending between the first upper surface of the base member and the lower surface of the bottom leg in order to secure the plate above the base plate.

12. The removal device as in claim 11 wherein the first plane and the second plane are parallel.

13. The removal device as in claim 12 wherein the top leg is arcuate shaped.

14. The removal device as in claim 13 a first inside edge of the top leg is arcuate and a second inside edge of the bottom leg is straight.

15. The removal device as in claim 14 further comprising a handle extending upwardly from the third upper surface of the top leg.

16. The removal device as in claim 15 wherein a first distance between the pair of side legs is greater than a second distance between the bottom leg and the top leg.

17. The removal device as in claim 11 wherein the top leg is arcuate shaped.

18. The removal device as in claim 17 a first inside edge of the top leg is arcuate and a second inside edge of the bottom leg is straight.

19. The removal device as in claim 11 further comprising a handle extending upwardly from the third upper surface of the top leg.

20. The removal device as in claim 11 wherein a first distance between the pair of side legs is greater than a second distance between the bottom leg and the top leg.

* * * * *